United States Patent [19]

Sasaki et al.

[11] 4,398,995

[45] Aug. 16, 1983

[54] PAPERY PRODUCT

[75] Inventors: Hideharu Sasaki, Iwakuni; Tsutomu Nakamura, Yamaguchi; Keizo Shimada; Yuzo Aito, both of Iwakuni; Yutaka Tabe, Matsuyama, all of Japan

[73] Assignee: Teijin Limited, Yamaguchi, Japan

[21] Appl. No.: 265,583

[22] Filed: May 20, 1981

[30] Foreign Application Priority Data

May 26, 1980 [JP] Japan ..... 55-68979

[51] Int. Cl.[3] ..... D21H 5/20

[52] U.S. Cl. ..... 162/157.3; 162/146

[58] Field of Search ..... 162/146, 157 R, 157.3; 428/395, 373, 374, 364

[56] References Cited

U.S. PATENT DOCUMENTS 4,309,476 1/1982 Nakamura et al. ..... 428/373

4,337,155 6/1982 Sasaki et al. ..... 210/500.1

FOREIGN PATENT DOCUMENTS 51-92400 8/1976 Japan ..... 162/157 R

*Primary Examiner*—William F. Smith

*Attorney, Agent, or Firm*—Burgess, Ryan & Wayne

[57] ABSTRACT

A papery product consisting essentially of a fibrous web, at least part of said web being made of a wholly aromatic polyamide fiber having a readily soluble skin layer and a sparingly soluble or insoluble core layer, and pressure and heat being applied to said web. Said product is excellent in its mechanical and heat-resisting properties.

8 Claims, No Drawings

PAPERY PRODUCT

This invention relates to a papery product. More particularly, this invention relates to a papery product having an excellent heat-resisting property and a superior flame retardant property.

Heretofore, it has been widely known to produce a papery product using a substrate of a synthetic fiber such as polyester or nylon or a chemical fiber such as rayon and bonding or matting the fiber using a binder or a suitable plasticizer. The resulting product is inferior in its heat-resisting property and flame retardant property and is not suitable for uses in the fields of a building material, an interior material, an electrical insulating material, etc.

For these uses, there has been proposed a papery product formed mainly of a fiber made of wholly aromatic polyamide, especially, poly-m-phenylene isophthalamide, which is excellent in its heat-resisting property and flame retardant property.

For example, a poly-m-phenylene isophthalamide solution in an amide polar solvent is dispersed into a dispersing medium formed mainly of water to prepare a thin foliated body having a specific configuration, the thin foliated body is then mixed and intertwined with a fiber in water and dried, and the materials are subjected to heat and pressure to prepare a papery product (Japanese Patent Publication No. 35-11851).

According to this method, a papery product which is compact in structure and excellent, especially, in its electrical insulating property can be obtained, but since the process for preparing the thin foliated body and the papermaking step use a large amount of water, this method requires a considerably large amount of energy in the solvent recovering step and the drying step.

To solve this problem, it has been desirable to produce a papery product of high density without employing a papermaking process which requires a specific binder and a complicated system and it has been proposed to apply heat and pressure to wholly aromatic polyamide fiber having a low degree of orientation and a low degree of crystallinity (Japanese Laid-open Patent Application No. 52-105975).

However, according to this method, since the wholly aromatic polyamide fiber used is inferior in mechanical strength and heat-resistance, the thus obtained papery product inevitably has poor mechanical strength and poor heat-resistance. To improve these properties, it has been proposed to apply heat-treatment or blend a fiber of high orientation degree and crystallinity, but the heat-resisting property and the mechanical properties inherent in the wholly aromatic polyamide have not successfully been developed until now.

The inventors have previously proposed a wholly aromatic polyamide fiber having a readily soluble skin layer and a sparingly soluble or insoluble core layer (Japanese Patent Application No. 54-49779). Now, it has been found that the skin layer effectively acts as a bonding agent when applied with heat and pressure and yet the core layer effectively strengthens the mechanical property and heat-resisting property thereof. Thus, the present invention has been achieved.

Thus, this invention provides a papery product consisting essentially of a fibrous web, at least part of said web being made of a wholly aromatic polyamide fiber having a readily soluble skin layer and a sparingly soluble or insoluble core layer, said web being formed with application of pressure and heat.

The wholly aromatic polyamide usable for the present invention contains repeating units of formulae (I) and (II), $$\left[ NR_1-Ar_1-\overset{\overset{\displaystyle O}{\|}}{C} \right] \quad \text{(I)}$$

$$\left[ NR_2-Ar_2-NR_3-\overset{\overset{\displaystyle O}{\|}}{C}-Ar_3-\overset{\overset{\displaystyle O}{\|}}{C} \right] \quad \text{(II)}$$

wherein $Ar_1$, $Ar_2$ and $Ar_3$ respectively represent, independently from each other, an unsubstituted or substituted divalent aromatic radical which comprises a single aromatic ring, or two or more aromatic rings that are condensed together, or are linked together by a single bond, or by a bridging atom or radical, and which is oriented either meta or para, and $R_1$, $R_2$ and $R_3$ respectively represent, independently from each other, a hydrogen atom or an alkyl radical having 1 to 3 carbon atoms.

In the formulae (I) and (II), it is preferable that $Ar_1$, $Ar_2$ and $Ar_3$ be respectively selected, independently from each other, from the group consisting of the radicals of the formulae:

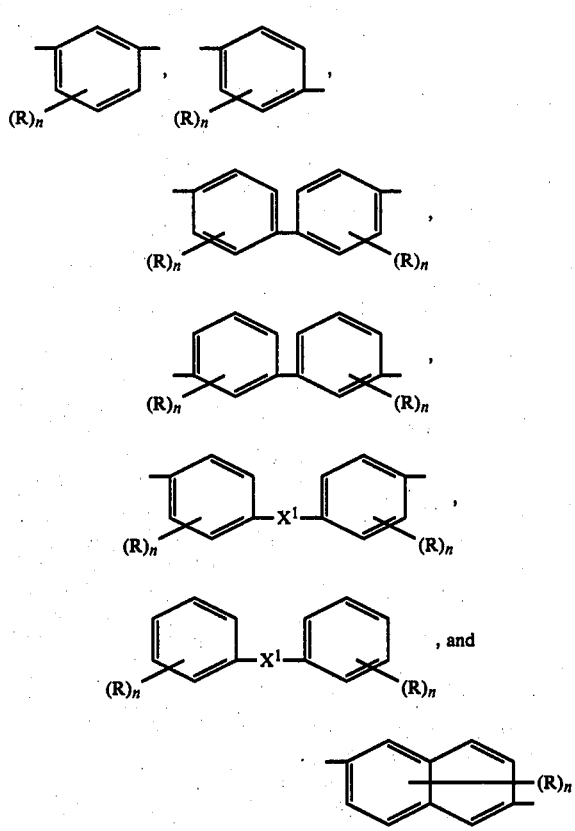

wherein R represents a member selected from the group consisting of lower alkyl radicals having 1 to 6 carbon atoms, lower alkoxy radicals having 1 to 6 carbon atoms, halogen atoms and a nitro radical, n represents zero or an integer of from 1 to 4 and $X^1$ represents a member selected from the group consisting of:

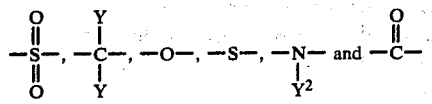

wherein $Y^2$ represents a member selected from the group consisting of a hydrogen atom and lower alkyl radicals having 1 to 6 carbon atoms.

Also, in the formulae (I) and (II), it is more preferable that $Ar_1$, $Ar_2$ and $Ar_3$ respectively represent, independently from each other, a member selected from p-phenylene radical, m-phenylene radical, biphenylene and radicals of the formulae:

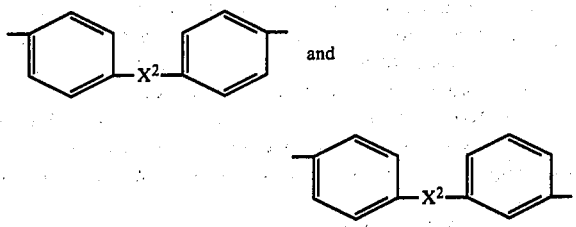

wherein $X^2$ represents a member selected from

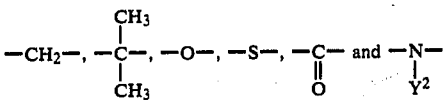

in which $Y^2$ represents a hydrogen atom or an alkyl radical having 1 to 3 carbon atoms.

Furthermore, in the formulae (I) and (II), it is still more preferable that $Ar_1$, $Ar_2$ and $Ar_3$ be respectively a p-phenylene or m-phenylene radical.

Moreover, it is preferable that the aromatic polyamide contain the repeating units of the formula (II) in which $Ar_2$ and $Ar_3$ are respectively a p-phenylene or m-phenylene radical, most preferably, a m-phenylene radical.

The aromatic polyamide may contain 30 molar % or less of one or more comonomers, for example, aliphatic diamines, such as hexamethylene diamine and piperazine, and aliphatic dicarboxylic acid, such as adipic acid, based on the entire molar amount of the comonomers contained in the polyamide.

The wholly aromatic polyamide fiber, having a readily soluble skin layer and a sparingly soluble or insoluble core layer which is employable in the present invention, exhibits various characteristic properties as described in Japanese Patent Application No. 54-49779.

First, the fiber exhibits remarkable characteristics in its dyeing property. The fiber can be colored deep by an ordinary dyeing method and in an ordinary dyeing time, but, when a section of the fiber is observed using a light microscope, it is evident that the dye is dispersed only within the skin layer and is not dispersed into the core layer. There is caused no change in this characteristic even after the fiber has been subjected to dyeing for a time longer than the ordinary dyeing time, e.g., more than five hours.

Second, the fiber exhibits remarkable solubility characteristics. It has been known that, for example, a polymer of poly-m-phenylene isophthalamide or a poly-m-phenylene isophthalamide which has not been subjected to heat treatment or hot drawing is soluble in concentrated sulfuric acid or N-methyl-2-pyrrolidone (NMP), while a common, heat-treated or hot drawn poly-m-phenylene isophthalamide fiber is dissolved in concentrated sulfuric acid but is not dissolved in NMP because of its high-degree of orientation and crystallization. By contrast, the fiber having a readily soluble skin layer and a sparingly soluble or insoluble core layer shows a characteristic whereby only the skin layer thereof is dissolved in NMP at room temperature but the core layer is not dissolved thereinto.

Of course, the fiber is wholly dissolved in concentrated sulfuric acid at room temperature. More particularly, although it is natural that the dissolution behavior is varied depending upon conditions such as the kind of solvent, temperature, time, etc., a common, heat-treated and hot-drawn poly-m-phenylene isophthalamide fiber is not substantially dissolved, under dissolution conditions (kind of solvent temperature, time, etc.) while a polymer powder of poly-m-phenylene isophthalamide having a low degree of crystallinity or a poly-m-phenylene isophthalamide fiber which has not been heat-treated or hot-drawn is completely dissolved, as in the case of a fiber where only the skin layer is dissolved and the core layer remains undissolved. This is a second substantiation for a double-layer structure of the fiber. In this case, the percentage of the undissolved portion of the fiber on the basis of the entire fiber is determined by the ratio of the core layer to the skin layer and the dissolution conditions (kind of solvent, temperature, time, etc.).

For example, when the fiber in a solvent of N-methyl pyrrolidone is stirred at a temperature of 35° C. for one hour, a drawn and heat-treated poly-m-phenylene isophthalamide fiber is not substantially dissolved under these conditions, whereas a polymer powder of poly-m-phenylene isophthalamide or a poly-m-phenylene isophthalamide fiber which has not been subjected to heat-treating or a drawing operation is substantially 100% dissolved. In the double-layer structural fiber employed in the present invention, the cross-sectional area of the dissolved portion corresponds to from 10 to 80% and the cross-sectional area of the undissolved portion corresponds to from 90 to 20%.

This shows that the skin layer of the double-layer structural fiber has a lower degree of crystallinity as compared with the drawn or heat-treated poly-m-phenylene isophthalamide fiber or the core layer of the double-layer structural fiber. Accordingly, when a web formed partially of such a double-layer structural fiber is subjected to heat and pressure, hot-fusion bonding is effected on the skin layer and the core layer having a high degree of orientation and crystallinity imparts a high heat-resisting property, improved mechanical properties, etc. to the web. As a result, a desirable papery product excellent in its heat-resisting property, mechanical property, etc. and free from residual solvent etc. can be obtained.

A process for producing a wholly aromatic polyamide fiber having the double-layer structure as described above will now be described using examples, but the present invention is by no means limited to these processes.

While there have been known several methods for producing a poly-m-phenylene isophthalamide fiber, one example of the process for producing the double-layer structural fiber used in the present invention is such that a spinning solution of poly-m-phenylene isophthalamide is extruded into a coagulating bath to form a filament, the filament is washed with water, the washed filament is drawn in boiling water and then wound while being drawn. The conditions for obtaining a common, strong poly-m-phenylene isophthalamide fiber differ, in various points, from the conditions for obtaining the double-layer structural fiber used in the present invention.

This is summarized as follows:

To obtain the double-layer structural fiber of the present invention, the kind of solvent for the spinning stock of poly-m-phenylene isophthalamide is not critical so long as it can dissolve poly-m-phenylene isophthalamide. The spinning stock may contain a salt known as a solubilizing auxiliary agent, e.g., calcium chloride, magnesium chloride, zinc chloride, lithium chloride, etc.

While the formulation of the spinning solution is determined by a percentage composition of poly-m-phenylene isophthalamide, solvent, solubilizing auxiliary agent, etc., it is not critical for the purpose of obtaining the fiber of the present invention. Such a formulation is not suitable if the viscosity of the spinning solution is too high or too low.

While the coagulating conditions are determined by the kind, formulation and viscosity of the coagulating bath, it is preferred that the coagulating bath be an aqueous solution of an inorganic salt. As the inorganic salts, there can be mentioned calcium chloride, zinc chloride, magnesium chloride, etc. The aqueous solution of the inorganic salt may contain the solvent or the solubilizing auxiliary agent, etc., which are contained in the spinning stock. The temperature of the coagulating bath suitably ranges from room temperature to 150° C., and a preferable temperature is determined according to the temperature, kind and formulation of the spinning stock and the kind and formulation of the coagulating solution.

The coagulated filament is washed with water at a temperature of 0° to 50° C., preferably at a temperature of 0° to 25° C. The amount of the solvent retained in the filament under washing, prior to drawing in boiling water is preferably reduced as much as possible. It is not desirable for preparing the double-layer structural fiber of the present invention to retain a large amount of solvent in the filament being washed. The upper limit of the solvent which is retained in the filament being washed varies depending on other conditions such as the drawing conditions in boiling water or at an elevated temperature. To obtain a common, strong fiber, the content of the solvent retained in the filament under washing should be within a range between a certain upper limit and a certain lower limit. However, to obtain the fiber of the present invention, it is generally preferred that the content be lower than the lower limit of said range.

The washed filament is drawn in hot water and further subjected to hot drawing or heat treatment. The boiling water may be water of a temperature higher than 90° C. The temperature of hot drawing or heat treatment is from 200° to 390° C., preferably, 250° to 360° C., more preferably, 320° to 360° C. Assuming that the draw ratio in the drawing in the boiling water is $DR_1$ and the drawing ratio in the heat drawing is $DR_2$, the desired conditions for obtaining the fiber of the present invention is $DR_1 \times DR_2 < 4.3$ and $DR_1 > 1.5$, preferably, $DR_1 \times DR_2 < 3.5$ and $DR_1 > 2.5$. If $DR_1 \times DR_2$ is 4.3 or more while $DR_1$ is 1.5 or less, the formation of the double-layer structure of the fiber of the present invention is not advantageously effected or the strength of the fiber is so deteriorated that the fiber cannot have sufficient utility. It is necessary to obtain the fiber of the present invention, to dry the filament between the steps of drawing in the boiling water and the heat drawing or the heat treatment. The drying temperature is lower than 180° C., preferably, lower than 150° C., most preferably, lower than 120° C. A higher drying temperature is not desirable for obtaining the double-layer structure of the fiber of the present invention.

While the characteristic features of one process for obtaining the fiber of the present invention is described above, these features are generally different, in various points, from the conditions for obtaining a common, strong fiber of poly-m-phenylene isophthalamide. This is because the object of the present invention is not to obtain a common, strong fiber, but to obtain a fiber having a double-layer structure.

The fiber usable for the present invention may contain, in a skeleton of poly-m-phenylene isophthalamide, as a copolymer component, other monomers, for example, diamines or dicarboxylic acids in such an amount that the double-layer structure of the invention is not impaired. As typical examples of such a monomer, there can be mentioned p-phenylene diamine, terephthalic acid, 2,4- or 2,6-tolylene diamine, etc.

The double-layer structural fiber may contain various additives such as a flame-retarding agent, anti-static agent, etc. or a small amount of diverse polymers.

In the present invention, there may be blended, as fiber components of the web, fibers other than wholly aromatic polyamide fibers having a readily soluble skin layer and a sparingly soluble or insoluble core layer as described above, unless they will not impair the heat-resisting property, the electrical property or mechanical property.

As fibers employable, there can be mentioned:

(1) Common, single-layer structural fibers made of wholly aromatic polyamide as described above;
(2) Fibers made of a nitrogen-containing poly heterocyclic compound such as; Fibers of aromatic polyamide imide, polyazole, polybenzazole, polyhydantoin, polyparabanic acid, polyquinazolinedione, polyquinazolone, polyquinoxaline, polyoxazinone and the like.
(3) Aromatic polyether fibers such as; Fibers of polyphenylene oxide, polyarylene oxide and the like.
(4) Polyester fibers such as; Fibers of polyethylene-2,6-naphthalate, polyethylene-2,7-naphthalate, polyethylene terephthalate and the like.
(5) Polyamide fibers;
(6) Fibers made of inorganic compounds such as; glass fiber, asbestos fiber, rock wool fiber, slag cotton, silica fiber, bauxite fiber, kainite fiber, boron fiber, potassium titanate fiber and magnesia fiber, and whiskers such as alumina and silicon dioxide.
(7) Natural fibers such as; Cellulose fiber, regenerated fiber, cellulose acetate fiber, etc.

Particles of wholly polyamide polymer may be contained to improve the mechanical strength and/or the surface smoothness of the papery product.

The "web" used in the present invention means a papermade sheet using an ordinary web-forming system such as a method in which crimp is imparted to a fiber, the cut staple fiber is matted by a card; a method for opening the tow of a long fiber; or a method wherein a fiber is cut into short filaments of 5 to 20 mm and dispersed with water or pressurized air. The thickness of the web may be selected as desired. The web may have been treated with an additive for retaining the configuration of the web.

As the tow opening method for long fiber, there can be mentioned a method wherein, for example, sheets of long fiber are laid on each other and over-fed by a feeding roller and the fiber laminate is expanded in the direction of its width using a divergent belt with needles fixed thereto to form a web. This method is advantageously employed to form a web. Application of heat and pressure to the obtained web is suitably carried out according to the desired properties required for the product.

The equipment for applying heat and pressure may be an ordinary heat and pressure applying equipment such as a heat-and-pressure calender, hot-press, etc. The conditions for the heating and pressing may vary depending upon the type and speed of the equipment used. However, in general, the heating and pressing treatment may preferably be carried out at a temperature of 200° to 350° C. and a pressure of higher than 50 kg/cm$^2$.

According to the process of the present invention, the skin layer of aromatic polyamide fiber having a skin-core layer is softened and fused, at the heat and pressure applying step, to bind fibers for forming a papery product having excellent heat-resisting and flame-retarding properties and sufficient strength and elongation characteristics.

The thus obtained papery product has no color development and keeps sufficient tensile strength and elongation even after it has been left at a temperature of 250° C. for a long time.

The obtained papery product can suitably be used not only for ordinary purposes, but also as a building material, interior material and electrical insulating material all of which are required to have heat resistance and flame-retarding properties.

Embodiments of the present invention will now be described with reference to the following examples. In the examples, the solubility of the fiber is measured in accordance with the following procedures. Fibers having a length of 5 mm were opened, subjected to an operation for removing oily materials, using methanol and chloroform at a temperature equal to their boiling points for 30 minutes, respectively, and then, dried at a temperature of 105° C., for two hours, under a vacuum condition. About 0.5 g of the sampled fibers were accurately weighed ($W_0$). The fibers were stirred in 20 cc of NMP at a temmperature of 30° C. for one hour and the undissolved portion was put into a glass filter and washed sufficiently with NMP and, then, with water and with methanol. The portion was dried at a temperature of 105° C., for two hours, under a vacuum condition. The dried undissolved portion was then weighed ($W_1$). The dissolved amount % by weight of the fibers was calculated in accordance with the equation:

$$\text{Dissolved amount (\% by weight)} = \frac{W_0 - W_1}{W_0} \times 100\ (\%)$$

The inherent viscosity (I.V.) of the polymer was determined in such a manner that about 50 mg of the polymer was accurately weighed, and, then, dissolved in 10.0 ml of concentrated sulphuric acid at room temperature. A time necessary for passing a predetermined amount of solvent and solution through an Ostwald's viscometer was measured, and the inherent viscosity was calculated in accordance with the equation:

$$I.V. = \frac{\ln t/t_o}{C}$$

t: the time in seconds for solution
$t_o$: the time in seconds for sulfuric acid
C: the concentration of the solution, g/100 ml

EXAMPLES 1 TO 3

A spinning solution prepared from 22 parts of poly-m-phenylene isophthalamide (I.V.=1.85) polymerized from m-phenylene diamine and isophthalic acid chloride, 77 parts of calcium chloride and 100 parts of N-methyl-2-pyrrolidone was extruded through a spinneret having 100 spinning holes, each having a diameter of 0.08 mm, into a bath consisting mainly of an aqueous solution of 50% by weight of calcium chloride, at a rate of 2 g/min, to coagulate the extruded materials. The coagulated filaments were washed with water at a temperature of 15° C., and, then, washed with hot water. The washed filaments were drawn in hot water, at a draw ratio of 2.63 and dried at a temperature of from 110° C. to 120° C. on drying rollers. The filaments were drawn on a hot plate of 350° C. at a draw rate of 1.20. The filaments were wound by a winder. The resultant yarn had a fineness of 200 denier, 4.5 g/de of tensile strength and 68% of ultimate elongation. The dissolved amount of the filaments was 31%.

The filaments were crimped 11 or 12 times/20 mm, then, cut into staple fibers 51 mm long, carded using a cloth-laid webber, and needled at a punching density of 81/cm$^2$ to obtain a web 1 m wide. The web was subjected to heat and a pressure applying operation on a hot press under conditions of various heat temperatures and 200 kg/cm$^2$ pressure, for four minutes. The properties of the resultant papery product are summarized in Table 1. In the table, the properties measured after heat-treatment at 250° C. for 500 hours are also shown.

TABLE 1

| Example | Press Temp., °C. | Thickness. μ | Density, g/cm$^3$ | Strength, kg/mm$^2$ | Elongation, % | Strength after heat-treatment kg/mm$^2$ | Elongation after heat-treatment % |
|---|---|---|---|---|---|---|---|
| Example 1 | 290 | 204 | 0.60 | 6.2 | 13.8 | 6.1 | 13.5 |
| Example 2 | 310 | 182 | 0.70 | 10.2 | 33.0 | 10.0 | 32.0 |
| Example 3 | 330 | 105 | 0.92 | 10.2 | 18.6 | 10.1 | 18.0 |

COMPARATIVE EXAMPLE 1

A N-methyl-2-pyrrolidone solution of 22% by weight of poly-m-phenylene isophthalamide (I.V.=1.80) was used as a spinning solution, and the solution was extruded into an aqueous solution consisting mainly of 43% by weight of calcium chloride at a temperature of 95° C. through a spinneret having 100 spinning holes, each having a diameter of 0.08 mm, at a rate of 2 g/min to coagulate the material. The coagulated filaments were washed with an aqueous solution at a temperature of 20° C., and, then, washed with hot water at a temperature of 70° C. The washed filaments were drawn in boiling water at a draw ratio of 2.30 and dried at a temperature of 130° C. on drying rollers. The dried filaments were further drawn on a hot plate at a temperature of 350° C. at a draw ratio of 1.82. The filaments were then wound by a winder. The resultant yarn had a strength of 5.50 g/de and an elongation of 36%. The dissolved amount of the filaments was 0%.

The filaments were crimped, cut into fibers 51 mm long and fed to a carding machine to obtain a web. The obtained web was subjected to a heat and pressure applying operation, using a hot press, at a temperature of 330° C. and at a pressure of 200 kg/cm$^2$, for four minutes. The filaments were not sufficiently bound and a papery product could not be obtained.

COMPARATIVE EXAMPLE 2

A N-methyl-2-pyrrolidone solution of 22% by weight of poly-m-phenylene isophthalamide (I.V.=1.80) was used as a spinning solution, and the solution was extruded into an aqueous solution consisting mainly of 43% by weight of calcium chloride at a temperature of 95° C., through a spinneret having 100 spinning holes, each having a diameter of 0.08 mm, at a rate of 2 g/min to coagulate the material. The coagulated filaments were washed with an aqueous solution at a temperature of 20° C., and, then, washed with hot water at a temperature of 70° C. The washed filaments were dried at a temperature of 130° C. on drying rollers to obtain an undrawn yarn (A). The resultant yarn had a strength of 1.0 g/de and an elongation of 400%. The dissolved amount of the filaments was 100%.

The above-mentioned procedure was repeated, except that the filaments washed with water at 70° C. were drawn in boiling water at a draw ratio of 2.75, to obtain a drawn yarn (B). The obtained yarn had a strength of 3.0 g/de and an elongation of 50%. The dissolved amount of the filaments was 100%.

The filaments were crimped and cut into staple fibers 51 mm long, as described in Example 1. The obtained fibers (A) or (B) or a blend of the fibers (A) or (B) with the fibers (C) obtained in Comparative Example 1 of a weight ratio or 60:40 were formed into a web having a width of 1 m and a weight of 150 g/m$^2$ in the same manner as in Example 1. Each web was hot-pressed, using a hot press, at a temperature of 330° C. and at a pressure of 200 kg/cm$^2$, for 4 minutes. The properties of the obtained products are shown in Table 2 together with the properties measured after heat-treatment at 250° C. for 500 hours.

TABLE 2

| Web-composing fiber | Thickness μ | Strength kg/mm$^2$ | Elongation % | Strength after heat-treatment kg/mm$^2$ | Elongation after heat-treatment % |
|---|---|---|---|---|---|
| A | 140 | 7.2 | 5 | 3.2 | 2 |
| B | 157 | 6.7 | 7 | not measurable | |
| A/C (60/40) | 180 | 4.8 | 10 | 4.4 | 6 |
| B/C (60/40) | 192 | 4.5 | 12 | 4.2 | 8 |

The webs obtained using the fibers (A) and (B) were both inferior in their heat-resisting property. The webs obtained using the blend fibers necessitated a blending operation and, further, were inferior in the initial properties.

EXAMPLE 4

The filaments used in Example 1 were blended with the filaments used in Comparative Example 1 at a ratio of 60 to 40 to prepare a web. The web was subjected to a heat and pressure applying operation at a temperature of 310° C. and at a pressure of 200 kg/cm$^2$ for four minutes, the resultant papery product had a strength of 6.0 kg/mm$^2$ and an elongation of 16%. The strength and elongation after heat-treatment at 250° C. for 500 hours was 5.8 kg/mm$^2$ and 15.5%, respectively.

EXAMPLE 5

Filaments obtained by similar procedures to those of Example 1 were cut into short filaments 7 mm long. The short filaments were dispersed by pressurized air using an ejector having an air supply conduit, a fiber supply conduit and a discharging slit, and, then, caught on a metal net to form a sheet. The sheet was subjected to a pressure and heat applying operation at a temperature of 310° C. and a pressure of 200 kg/cm$^3$ for four minutes to obtain a papery product having such properties as a strength of 7.0 kg/mm$^2$ and an elongation of 10%. The strength and elongation after heat-treatment at 250° C. for 500 hours was 6.7 kg/mm$^2$ and 9.7%, respectively.

EXAMPLE 6

Tows of the filaments obtained in Example 1 were laminated and guided through a feed roller. The laminate was held, at ends thereof, by a pair of divergent belts with needles provided thereon which were disposed just after the feed roller, after overfeeding twice the normal feeding distance. The laminate was expanded in the width direction 10 times as wide as the original width, to form an expanded web having a weight of 100 g/m$^2$. The web was subjected to a heat-and-pressure processing, using a press roller, at a temperature of 250° C. at a pressure of 100 kg/cm$^2$ to obtain a papery product having an excellent surface smoothness. The obtained papery product had a strength of 9.2 kg/mm$^2$ and an elongation of 23%. The strength and elongation after heat-treatment at 250° C. for 500 hours was 9.1 kg/mm$^2$ and 20%, respectively.

EXAMPLE 7

Filaments obtained by procedures similar to those of Example 1 were cut into short filaments 7 mm long, dispersed into water and formed into a sheet having a weight of 100 g/m$^2$, using a TAPPI standard sheet machine. The resultant sheet was subjected to a heat and pressure applying operation at a temperature of 310° C. and a pressure of 200 kg/cm$^2$ for four minutes to obtain a papery product having properties a strength of 6.8 kg/mm$^2$ and an elongation of 10%. The strength and elongation after heat-treatment at 250° C. for 500 hours was 6.5 kg and 9.5%, respectively.

EXAMPLES 8 TO 12

Using procedures as in Example 3, various wholly aromatic polyamide filaments as given below were blended with the filaments used in Example 1 at a ratio of 40 to 60 to obtain webs, each having a weight of 100 g/m$^2$. The webs were subjected to heat and pressure applying operation at a temperature of 310° C. at a pressure of 200 kg/cm$^2$ for four minutes to obtain papery products each having an excellent heat resistance and a good surface smoothness.

When the following wholly aromatic polyamide fibers above were used and pressed in a manner as described above, the dimension stability was deteriorated and no desired papery product was obtained.

| Example | Wholly aromatic polyamide: Main acid. component | Wholly aromatic polyamide: Main amine component | Properties of single yarn: Strength, g/de | Properties of single yarn: Elongation, % | Web preparing method |
|---|---|---|---|---|---|
| 8 | 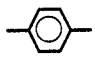 | 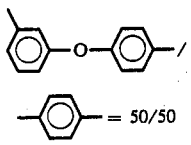 = 50/50 | 25 | 5 | Wet type preparation, using short filaments 7 mm long |
| 9 | 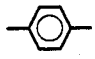 | 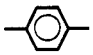 | 22 | 4 | Preparation by carding, using crimped filaments 51 mm long |
| 10 | 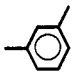 | 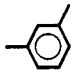 | 1.5 (undrawn and non-heat-treated) | 4 | Preparation by carding, using crimped filaments 51 mm long |
| 11 | 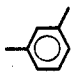 | 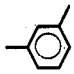 | 3.0 (drawn in hot water but non-heat-treated) | 42 | Preparation by carding, using crimped filaments 51 mm long |
| 12 | 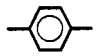 | 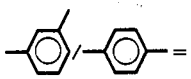 = 95/5 | 8 | 14 | Preparation by carding, using crimped filaments 51 mm long |

EXAMPLE 13

95% of the crimped filaments used in Example 1 (51 mm long) which had been opened by a card was blended with potassium titanate filaments to prepare a web. The web was pressed at a temperature of 290° C. to obtain a papery product having a strength of 6.0 kg/mm$^2$ and an elongation of 10%.

EXAMPLE 14

50% of the crimped filaments used in Example 1 (51 mm long) was preliminarily blended with 50% of crimped filaments (51 mm long) made of polyethylene-2,6-naphthalate and formed into a web using a card. The web was pressed at a temperature of 290° C. to obtain a papery product having a strength of 6.4 kg/mm$^2$ and an elongation of 12%.

What is claimed is:

1. A papery product consisting essentially of a fibrous web, at least part of said web being made of a wholly aromatic polyamide fiber having a core comprising an aromatic polyamide material extending along the longitudinal axis of said fiber and a sheath, surrounding said core, comprising the same aromatic polyamide material as said core, said core being substantially insoluble and said sheath being substantially soluble in N-methyl-2-pyrrolidone at a temperature of 35° C., pressure and heat having been applied to said web.

2. A papery product of claim 1, containing at least 5% by weight of said wholly aromatic polyamide fiber.

3. A papery product according to claim 1, wherein a pressure of higher than 50 kg/cm$^2$ and a temperature of 200° to 350° C. are applied.

4. A papery product of claim 1, wherein said wholly aromatic polyamide comprises: at least one aromatic polyamide containing repeating units of the formula selected from the group consisting of $$\left[NR_1-Ar_1-\overset{O}{\overset{\|}{C}}\right] \quad \text{(I)}$$

and $$\left[NR_2-Ar_2-NR_3-\overset{O}{\overset{\|}{C}}-Ar_3-\overset{O}{\overset{\|}{C}}\right] \quad \text{(II)}$$

wherein $Ar_1$, $Ar_2$ and $Ar_3$ are independent, an unsubstituted divalent aromatic radial, a substituted divalent aromatic radical which comprises a single aromatic ring, two or more condensed aromatic rings, two or more aromatic rings linked together, by a single bond, by a bridging atom or radical, and which are oriented either meta or para, and $R_1$, $R_2$ and $R_3$ respectively are independently hydrogen or alkyl having 1 to 3 carbon atoms.

5. A papery product as claimed in claim 4, wherein $Ar_1$, $Ar_2$ and $Ar_3$ in formula (I) and (II) are independently selected from the group consisting of moieties of the formula:

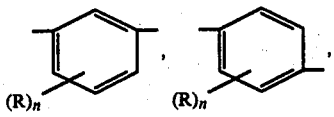

-continued

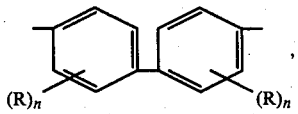

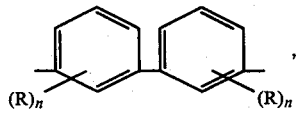

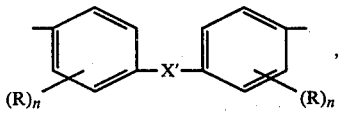

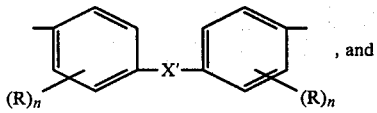

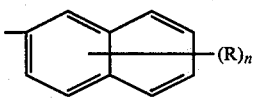

wherein R is a member selected from the group consisting of lower alkyl having 1 to 6 carbon atoms, lower alkoxy having 1 to 6 carbon atoms, halogen and nitro, n is zero or an integer of from 1 to 4 and X' is a member selected from the group consisting of

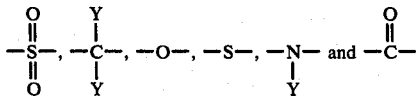

wherein Y is a member selected from the group consisting of hydrogen and lower alkyl having 1 to 6 carbon atoms.

6. A papery product as claimed in claim 4, wherein said $Ar_1$, $Ar_2$ and $Ar_3$ in the formula (I) and (II) respectively are independently a member selected from p-phenylene, m-phenylene, biphenylene and radicals of the formula:

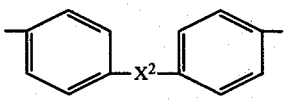

and

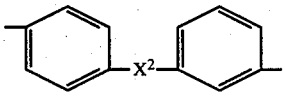

wherein $X^2$ represents a member selected from

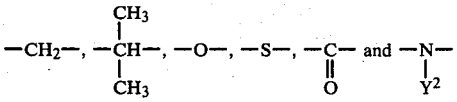

wherein $Y^2$ is hydrogen or alkyl having 1 to 3 carbon atoms.

7. A papery product as claimed in claim 4, wherein said wholly aromatic polyamide contains repeating units of the formula (II) in which said $Ar_2$ and $Ar_3$ are independently m-phenylene or p-phenylene.

8. A papery product as claimed in claim 7, wherein $Ar_2$ and $Ar_3$ are m-phenylene.

* * * * *